US012668342B2

(12) United States Patent
Go et al.

(10) Patent No.: US 12,668,342 B2
(45) Date of Patent: Jun. 30, 2026

(54) METHOD OF CONTROLLING ROTATIONAL SPEED OF PROPELLER OF SHIP TO REDUCE CAVITATION

(71) Applicant: MOTH CO., LTD., Daejeon (KR)

(72) Inventors: Yeong Ju Go, Daejeon (KR); Chang Sup Lee, Daejeon (KR)

(73) Assignee: MOTH CO., LTD., Daejeon (KR)

( * ) Notice: Subject to any disclaimer, the term of this patent is extended or adjusted under 35 U.S.C. 154(b) by 324 days.

(21) Appl. No.: 18/496,940

(22) Filed: Oct. 30, 2023

(65) Prior Publication Data

US 2025/0074565 A1 Mar. 6, 2025

(30) Foreign Application Priority Data

Sep. 1, 2023 (KR) ..... 10-2023-0115990

(51) Int. Cl.
*B63H 1/18* (2006.01)
*B63H 21/21* (2006.01)

(52) U.S. Cl.
CPC ..... *B63H 1/18* (2013.01); *B63H 21/21* (2013.01)

(58) Field of Classification Search
CPC ..... B63H 1/18; B63H 2/21
USPC ..... 701/21
See application file for complete search history.

(56) References Cited

U.S. PATENT DOCUMENTS

2004/0147182 A1* 7/2004 Reuter ..... B63H 5/08 440/66
2009/0226323 A1* 9/2009 Suzuki ..... B63H 1/26 416/223 R
2009/0266286 A1* 10/2009 Hong ..... B63H 5/16 114/288
2014/0271196 A1* 9/2014 Restea ..... B63H 1/12 416/85
2018/0327068 A1* 11/2018 Peters ..... B63H 23/02
2024/0076024 A1* 3/2024 Kawai ..... B63H 20/28

FOREIGN PATENT DOCUMENTS

KR 10-2010-0008497 A 1/2010
KR 20-0480458 Y1 5/2016
KR 10-2111521 B1 5/2020

* cited by examiner

*Primary Examiner* — Yazan A Soofi
(74) *Attorney, Agent, or Firm* — NKL Law; Jae Youn Kim

(57) ABSTRACT

Disclosed is a method of controlling a rotational speed of a propeller of a ship to reduce cavitation. The method may reduce cavitation by determining a rotational angle range of a propeller corresponding to a cavitation occurrence section when cavitation occurs during sailing of a ship and by increasing or reducing the rotational speed of the propeller within the determined rotational angle range of the propeller corresponding to the cavitation occurrence section. Therefore, it is possible to simply reduce cavitation only by controlling the rotational speed of the propeller without changing the structure of the propeller.

8 Claims, 5 Drawing Sheets

A

B

A

B

METHOD OF CONTROLLING ROTATIONAL SPEED OF PROPELLER OF SHIP TO REDUCE CAVITATION

BACKGROUND OF THE INVENTION

Field of the Invention

The present invention relates to a method of controlling the rotational speed of a propeller of a ship to reduce cavitation, and more particularly, to a control method of reducing cavitation by determining a rotational angle range of a propeller corresponding to a cavitation occurrence section when cavitation occurs during sailing of a ship and by increasing or reducing the rotational speed of the propeller within the determined rotational angle range of the propeller corresponding to the cavitation occurrence section.

Description of the Related Art

In modern society, due to the development of industry and transportation, a much greater number of people and goods are transported than in the past.

In particular, in countries that border the sea, for example, Korea surrounded by the sea on three sides, most goods are imported and exported by sea. In order to import and export goods by sea, large-scale ships sail on the sea. Such a ship sails using propulsive force generated by rotation of a propeller mounted thereto.

When a propeller rotates in the water, a vortex of air bubbles occurs around the propeller, which is called cavitation. Such cavitation is a main cause of noise and vibration of the hull.

In particular, noise and vibration of the hull caused by cavitation adversely affect a ship, for example, deteriorate durability of a ship. A large amount of cavitation may cause damage to a propeller, leading to a maritime accident. Therefore, it is required to reduce cavitation.

Further, in the case of military ships such as warships or submarines, the locations thereof may be easily exposed to the enemy due to noise generated therefrom. Therefore, military ships have a greater need to reduce cavitation.

Recently, a propeller having blades improved in structure to reduce cavitation has been developed. However, such a conventional cavitation-reducing propeller having blades improved in structure has cavitation reduction effect, but also has a drawback in that the intensity of propulsive force generated thereby is low due to the change in the structure of the blades.

Therefore, it is required to develop a method of reducing cavitation without change in structure of a propeller and resultant reduction in intensity of propulsive force.

In order to meet this requirement and solve the above problems with the related art, the present invention proposes a control method of reducing cavitation by determining a rotational angle range of a propeller corresponding to a cavitation occurrence section when cavitation occurs during sailing of a ship and by increasing or reducing the rotational speed of the propeller within the determined rotational angle range of the propeller corresponding to the cavitation occurrence section. Examples of related art are disclosed in the following documents.

RELATED ART DOCUMENT

Patent Document

1. Korean Patent Laid-Open Publication No. 10-2010-0008497 (entitled "APPARATUS AND METHOD FOR CONTROLLING SHIP VIBRATION INDUCED BY FLUCTUATING PRESSURE OF PROPELLER")
2. Korean Utility Model Registration No. 20-0480458 (entitled "BLADE ANGLE CONTROL DEVICE FOR OBSERVATION OF PROPELLER CAVITATION PHENOMENON")
3. Korean Patent Registration No. 10-2111521 (entitled "COMPRESSED AIR JET PRE-SWIRL STATOR AND SYSTEM USING THE SAME TO PREVENT DAMAGE TO PROPELLER DUE TO CAVITATION")

SUMMARY OF THE INVENTION

The present invention has been made to solve the above problems, and it is an object of the present invention to provide a control method of reducing cavitation by determining a rotational angle range of a propeller corresponding to a cavitation occurrence section when cavitation occurs during sailing of a ship and by increasing or reducing the rotational speed of the propeller within the determined rotational angle range of the propeller corresponding to the cavitation occurrence section.

In accordance with the present invention, the above and other objects can be accomplished by the provision of a method of controlling a rotational speed of a propeller of a ship to reduce cavitation, the method including a first step S100 of generating cavitation information about cavitation occurring during rotation of a propeller, a second step S200 of measuring a rotational angle of the propeller in real time after generating the cavitation information, and a third step S300 of changing a rotational speed of the propeller using the cavitation information generated in the first step S100 and information about the rotational angle of the propeller measured in real time in the second step S200 such that occurrence of cavitation is reduced. The cavitation information includes information about a rotational angle of the propeller at the time of occurrence of cavitation.

BRIEF DESCRIPTION OF THE DRAWINGS

The above and other objects, features, and other advantages of the present invention will be more clearly understood from the following detailed description taken in conjunction with the accompanying drawings, in which.

DETAILED DESCRIPTION OF THE INVENTION

Hereinafter, embodiments of the present invention will be described in detail with reference to the accompanying drawings.

A method of controlling the rotational speed of a propeller of a ship to reduce cavitation according to the present invention reduces cavitation by determining a rotational angle range of a propeller corresponding to a cavitation occurrence section when cavitation occurs during sailing of a ship and by increasing or reducing the rotational speed of the propeller within the determined rotational angle range of the propeller corresponding to the cavitation occurrence section. Accordingly, the present invention exhibits effects of simply reducing cavitation only by controlling the rotational speed of the propeller without changing the structure of the propeller.

Figure 1:
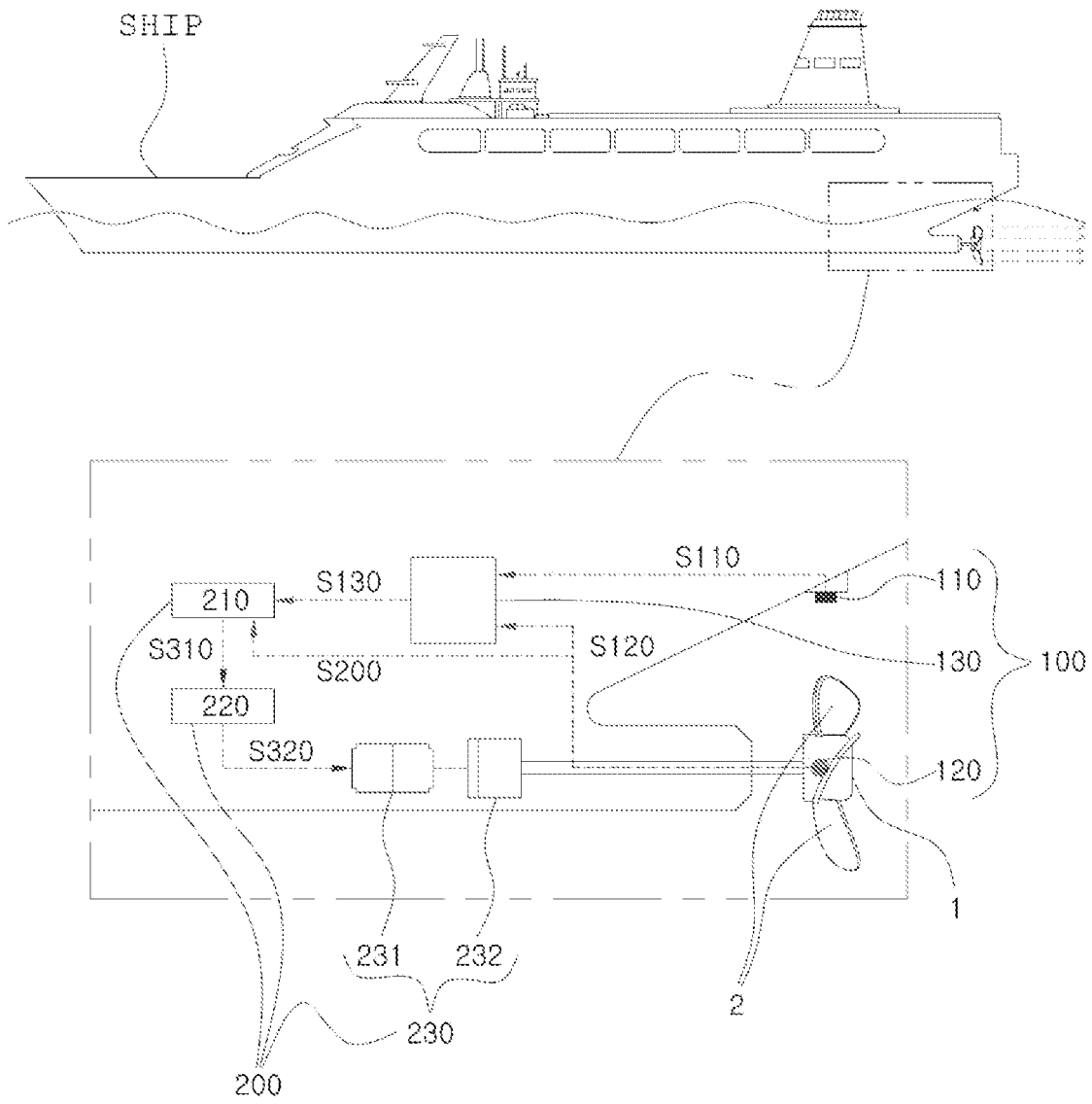
FIG. 1 is a conceptual view of the present invention.
Figure 2:
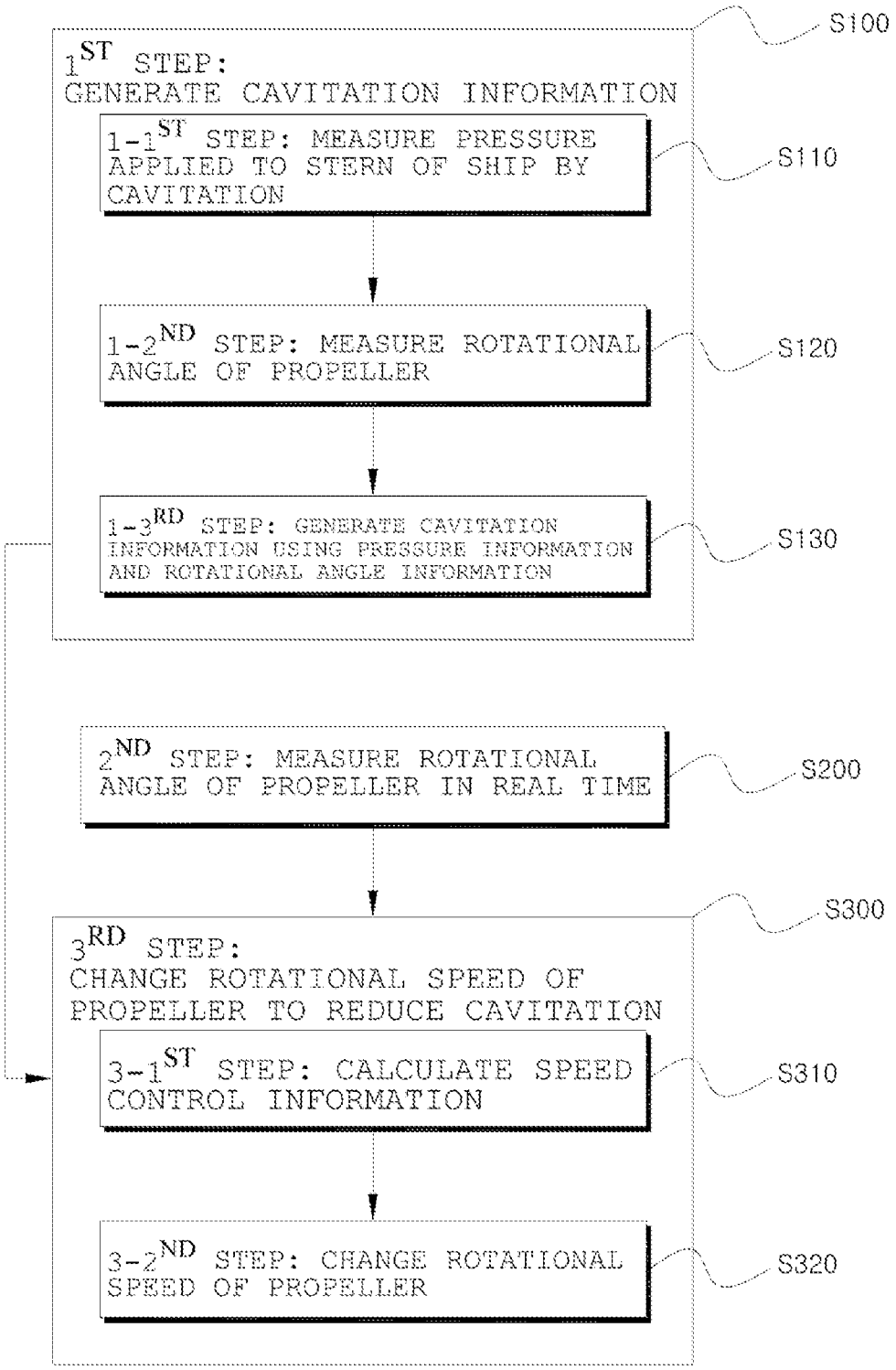
FIG. 2 is a flowchart showing the configuration of the present invention.

In detail, as shown in FIGS. 1 and 2, the method of controlling the rotational speed of a propeller of a ship to reduce cavitation according to the present invention includes a first step S100 of generating cavitation information about cavitation occurring during rotation of a propeller 1, a second step S200 of measuring a rotational angle of the propeller 1 in real time after generating the cavitation information, and a third step S300 of changing a rotational speed of the propeller 1 using the cavitation information generated in the first step S100 and information about the rotational angle of the propeller 1 measured in real time in the second step S200 such that occurrence of cavitation is reduced. The cavitation information includes information about the rotational angle of the propeller at the time of occurrence of cavitation.

When the propeller rotates in the water, a vortex of air bubbles occurs on surfaces of blades of the propeller, which is called cavitation. Such cavitation is a main cause of noise and vibration of the hull.

Noise and vibration of the hull caused by cavitation adversely affect a ship, for example, deteriorate durability of a ship. A large amount of cavitation may cause damage to a propeller, leading to a maritime accident. Further, in the case of military ships such as warships or submarines, the locations thereof may be easily exposed to the enemy due to noise generated therefrom. Therefore, it is required to reduce cavitation.

In particular, cavitation does not occur in all of rotational angle ranges of the rotating propeller, but occurs in some of the rotational angle ranges of the rotating propeller. The present invention reduces cavitation by generating cavitation information including information about the rotational angle of the propeller at the time of occurrence of cavitation in the first step S100, measuring the rotational angle of the propeller 1 in real time in the second step S200, and controlling the rotational speed of the propeller using the cavitation information and the real-time measured rotational angle of the propeller in the third step S300.

As shown in FIG. 1, the method of controlling the rotational speed of a propeller of a ship to reduce cavitation according to the present invention is executed by a control device that includes a cavitation information generator 100 and a rotational speed controller 200, which are mounted in the ship. The cavitation information generator 100 is an entity that performs the first step S100 and the second step S200, and the rotational speed controller 200 is an entity that performs the third step S300 of the present invention.

The cavitation information generator 100 is a part that generates cavitation information about cavitation occurring during rotation of the propeller 1 and provides the generated cavitation information and propeller rotational angle information to the rotational speed controller 200. The cavitation information generator 100 includes a pressure sensor 110, which measures fluctuating pressure applied to a stern of the ship located in the water by the cavitation occurring on surfaces of blades 2 of the propeller during rotation of the propeller 1, a rotational angle measurer 120, which measures the rotational angle of the rotating propeller, and a data processor 130, which generates cavitation information using information about the fluctuating pressure and the rotational angle of the propeller.

In addition, the rotational speed controller 200 is a part that changes the rotational speed of the propeller 1 using the cavitation information and the propeller rotational angle information provided by the cavitation information generator 100. The rotational speed controller 200 includes an information receiving module 210, which receives the cavitation information and the propeller rotational angle information from the cavitation information generator 100, a control information calculating module 220, which calculates speed control information, and a speed control module 230, which changes the rotational speed of the propeller.

The first step S100 is a step of generating cavitation information about cavitation occurring during rotation of the propeller 1. The cavitation information generated in the first step S100 includes information about the rotational angle of the propeller at the time of occurrence of cavitation. The first step S100 is performed by the cavitation information generator 100.

In detail, as shown in FIG. 2, the first step S100 includes a 1-1$^{st}$ step S110 of measuring fluctuating pressure applied to a stern of the ship located in the water by the cavitation occurring on the surfaces of the blades 2 of the propeller during rotation of the propeller 1, a 1-2$^{nd}$ step S120 of measuring the rotational angle of the rotating propeller to generate cavitation information, and a 1-3$^{rd}$ step S130 of generating cavitation information using information about the measured fluctuating pressure applied to the stern of the ship and information about the measured rotational angle of the propeller.

The 1-1$^{st}$ step S110 is a step of measuring fluctuating pressure applied to the stern of the ship located in the water by the cavitation occurring on the surfaces of the blades 2 of the propeller during rotation of the propeller 1. In detail, the 1-1$^{st}$ step S110 includes measuring first fluctuating pressure applied to the stern of the ship located in the water near a descending propeller blade 2 by cavitation occurring on the surface of the descending propeller blade 2 during rotation of the propeller 1 and measuring second fluctuating pressure applied to the stern of the ship located in the water near an ascending propeller blade 2 by cavitation occurring on the surface of the ascending propeller blade 2 during rotation of the propeller 1.

When the propeller 1 rotates in the water, the flow rate of water flowing along the surfaces of the propeller blades 2 constituting the propeller 1 increases compared to when the propeller is in a stationary state. As the flow rate of water increases, pressure applied to the surfaces of the blades 2 decreases according to Bernoulli's equation, and as the pressure decreases, a vortex of air bubbles occurs on the surfaces of the blades 2, which is called cavitation.

When cavitation occurs, the flow of water changes due to the cavitation, causing change in the pressure applied to the stern of the ship.

In other words, pressure applied to the stern of the ship when cavitation occurs is greater than pressure applied to the stern of the ship when cavitation does not occur.

Figure 3:
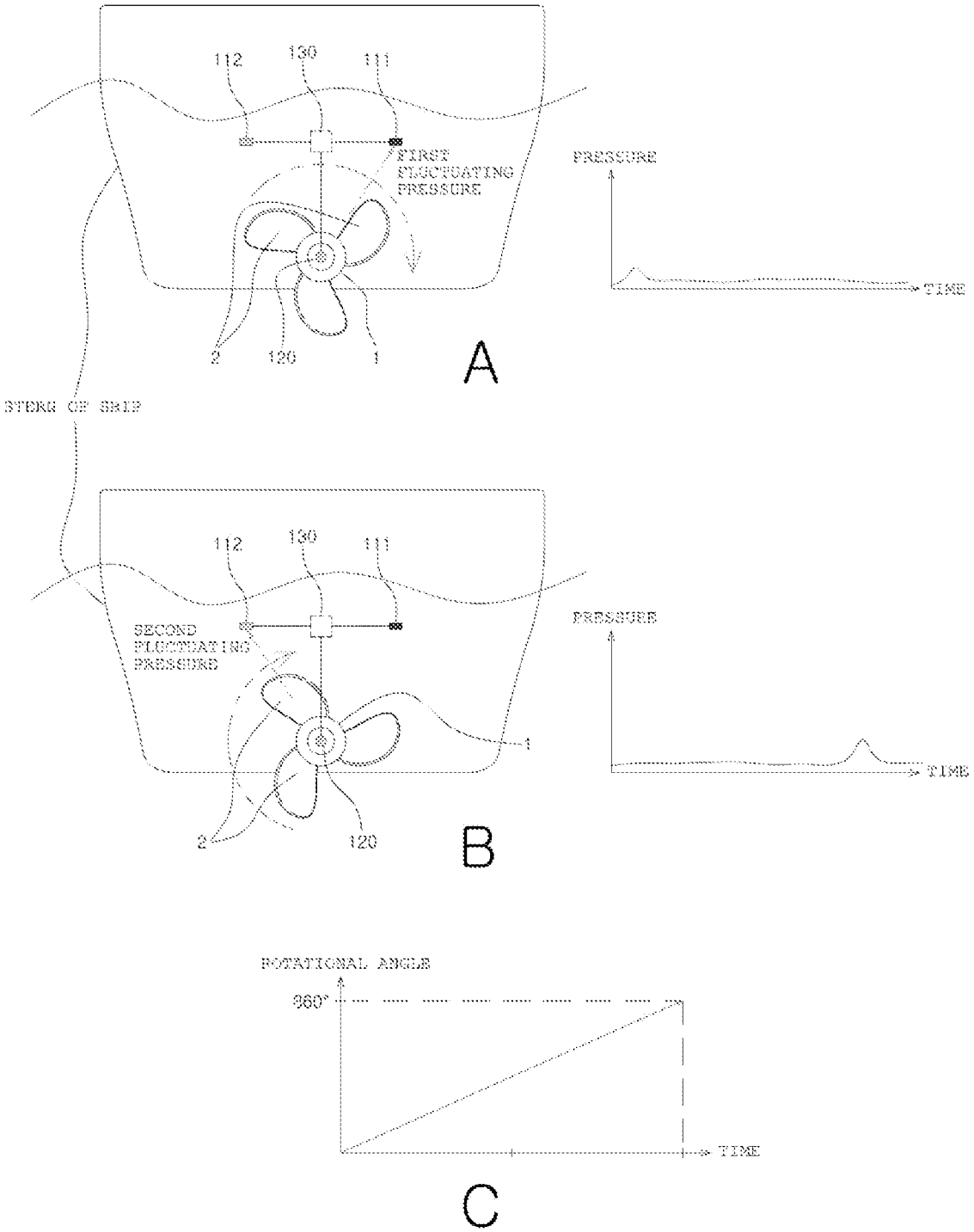
FIG. 3 is a view showing an example of performing a first step of the present invention.

As shown in FIG. 3, in order to detect pressure applied to the stern of the ship, a first pressure detection sensor 111 is mounted on a portion of the surface of the stern of the ship that is located in the water and located above the propeller 1 so as to be adjacent to a propeller blade 2 descending during rotation of the propeller 1, and a second pressure detection sensor 112 is mounted on a portion of the surface of the stern of the ship that is located in the water and located above the propeller 1 so as to be adjacent to a propeller blade 2 ascending during rotation of the propeller 1.

As shown in A of FIG. 3, the first pressure detection sensor 111 measures first fluctuating pressure, which is pressure applied to the stern of the ship (the stern of the ship located in the water near the descending propeller blade 2) by cavitation occurring on the surface of the descending propeller blade 2 among the rotating blades 2, and provides information about the measured first fluctuating pressure (refer to A of FIG. 3) to the data processor 130.

As shown in B of FIG. 3, the second pressure detection sensor 112 measures second fluctuating pressure, which is pressure applied to the stern of the ship (the stern of the ship located in the water near the ascending propeller blade 2) by cavitation occurring on the surface of the ascending propeller blade 2 among the rotating blades 2, and provides information about the measured second fluctuating pressure (refer to B of FIG. 3) to the data processor 130.

Therefore, through the 1-1$^{st}$ step S110, change in the pressure applied to the stern of the ship is detected, and a determination as to whether cavitation has occurred is made based thereon.

The 1-2$^{nd}$ step S120 is a step of measuring the rotational angle of the rotating propeller to generate cavitation information. The rotational angle of the rotating propeller is measured by the rotational angle measurer 120 mounted to the propeller.

In this case, the rotational angle measurer 120 measures the rotational angle of the rotating propeller 1 in real time, and provides information about the measured rotational angle of the propeller (refer to C of FIG. 3) to the data processor 130 and the rotational speed controller 200.

That is, when the cavitation information is generated, the rotational angle measurer 120 provides information about the real-time measured rotational angle of the propeller (refer to C of FIG. 3) to the data processor 130, and when rotation of the propeller is controlled after generation of the cavitation information, the rotational angle measurer 120 provides information about the real-time measured rotational angle of the propeller (refer to C of FIG. 3) to the rotational speed controller 200.

The 1-3$^{rd}$ step S130 is a step of generating the cavitation information using information about the measured fluctuating pressure applied to the stern of the ship and information about the measured rotational angle of the propeller.

In detail, the 1-3$^{rd}$ step S130 includes generating first cavitation information about cavitation occurring around the descending propeller blade 2 during rotation of the propeller 1 by time-synchronizing information about the first fluctuating pressure applied to the stern of the ship located in the water near the descending propeller blade 2 by cavitation occurring on the surface of the descending propeller blade 2 with information about the rotational angle of the propeller and using the time-synchronized information about the first fluctuating pressure and information about the rotational angle of the propeller, generating second cavitation information about cavitation occurring around the ascending propeller blade 2 during rotation of the propeller 1 by time-synchronizing information about the second fluctuating pressure applied to the stern of the ship located in the water near the ascending propeller blade 2 by cavitation occurring on the surface of the ascending propeller blade 2 with information about the rotational angle of the propeller and using the time-synchronized information about the second fluctuating pressure and information about the rotational angle of the propeller, and generating cavitation information including the first cavitation information and the second cavitation information.

The 1-3$^{rd}$ step S130 of generating the cavitation information is performed by the data processor 130 mounted in the ship.

Hereinafter, the process of generating the first cavitation information will be described.

In the 1-3$^{rd}$ step S130 performed by the data processor 130, the first cavitation information is generated by time-synchronizing the first fluctuating pressure information provided by the first pressure detection sensor 111 of the pressure sensor 110 with the propeller rotational angle information provided by the rotational angle measurer 120 and using the time-synchronized first fluctuating pressure information and propeller rotational angle information.

In this case, the first cavitation information is propeller rotational angle range information when the value of pressure applied to the stern of the ship located in the water near the descending propeller blade 2 is equal to or greater than a set value or propeller rotational angle information when the value of pressure applied to the stern of the ship located in the water near the descending propeller blade 2 is a peak value. That is, the first cavitation information is generated through the following two embodiments.

Hereinafter, a first embodiment of generating the first cavitation information will be described.

Figure 4:
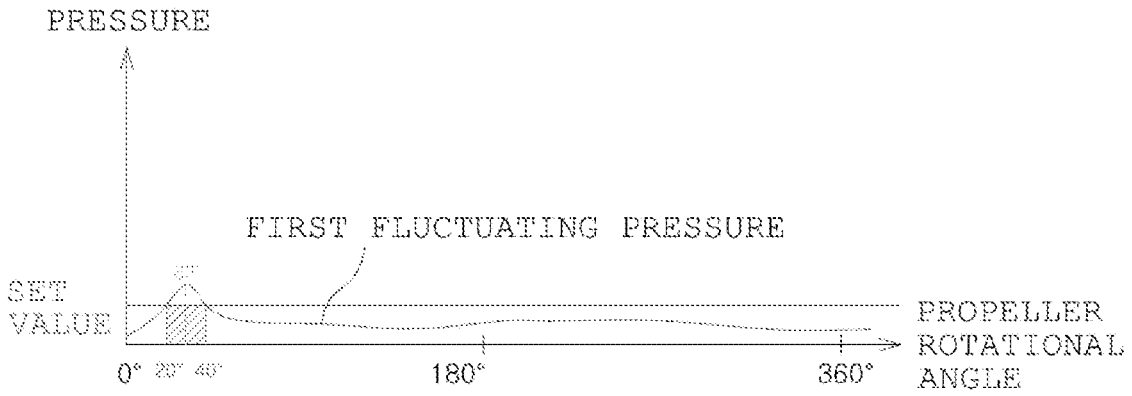
FIG. 4 is a view showing another example of performing the first step of the present invention.
Figure 4:
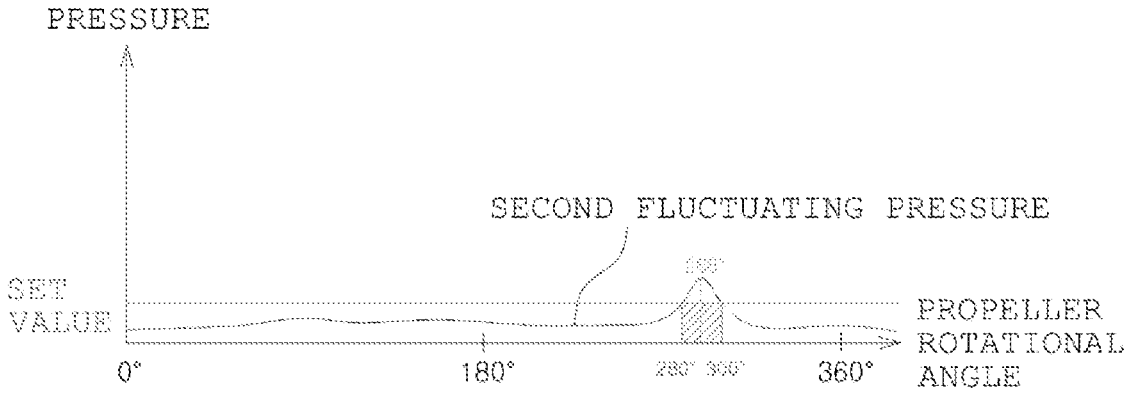

A of FIG. 4 is a view showing an example of time-synchronization of the first fluctuating pressure information provided by the first pressure detection sensor 111 with the propeller rotational angle information provided by the rotational angle measurer 120.

In the 1-3$^{rd}$ step S130, a propeller rotational angle range when the value of pressure applied to the stern of the ship located in the water near the descending propeller blade 2 is equal to or greater than a set value is determined using information obtained by time-synchronizing the first fluctuating pressure information provided by the first pressure detection sensor 111 with the propeller rotational angle information provided by the rotational angle measurer 120 (refer to A of FIG. 4), and information about the determined propeller rotational angle range is generated as the first cavitation information.

Referring to A of FIG. 4, a propeller rotational angle range when the value of pressure applied to the stern of the ship located in the water near the descending propeller blade 2 is equal to or greater than a set value is determined to be 20 to 40 degrees, and information about the determined propeller rotational angle range, i.e., 20 to 40 degrees, is generated as the first cavitation information.

When cavitation occurs, the flow of water changes due to the cavitation, causing change in the pressure applied to the stern of the ship. In other words, pressure applied to the stern of the ship when cavitation occurs is greater than pressure applied to the stern of the ship when cavitation does not occur. It can be seen from A of FIG. 4 that, when the rotational angle of the propeller is in the range of 20 to 40 degrees, pressure having a set value or more is applied to the stern of the ship located in the water near the descending propeller blade 2. This means that cavitation occurs on the descending propeller blade 2 when the rotational angle of the propeller is in the range of 20 to 40 degrees.

Hereinafter, a second embodiment of generating the first cavitation information will be described.

A of FIG. 4 is a view showing an example of time-synchronization of the first fluctuating pressure information provided by the first pressure detection sensor 111 with the propeller rotational angle information provided by the rotational angle measurer 120.

In the 1-3rd step S130, a propeller rotational angle when the value of pressure applied to the stern of the ship located in the water near the descending propeller blade 2 is a peak value is determined using information obtained by time-synchronizing the first fluctuating pressure information provided by the first pressure detection sensor 111 with the propeller rotational angle information provided by the rotational angle measurer 120 (refer to A of FIG. 4), and information about the determined propeller rotational angle is generated as the first cavitation information.

Referring to A of FIG. 4, a propeller rotational angle when the value of pressure applied to the stern of the ship located in the water near the descending propeller blade 2 is a peak value is determined to be 32 degrees, and information about the determined propeller rotational angle, i.e., 32 degrees, is generated as the first cavitation information.

When cavitation occurs, the flow of water changes due to the cavitation, causing change in the pressure applied to the stern of the ship. In other words, pressure applied to the stern of the ship when cavitation occurs is greater than pressure applied to the stern of the ship when cavitation does not occur. The highest pressure is applied to the stern of the ship when cavitation having the highest intensity occurs.

It can be seen from A of FIG. 4 that, when the rotational angle of the propeller is 32 degrees, the highest pressure is applied to the stern of the ship located in the water near the descending propeller blade 2. This means that cavitation having the highest intensity occurs on the surface of the descending propeller blade 2 when the rotational angle of the propeller is 32 degrees.

Hereinafter, the process of generating the second cavitation information will be described.

In the 1-3rd step S130 performed by the data processor 130, the second cavitation information is generated by time-synchronizing the second fluctuating pressure information provided by the second pressure detection sensor 112 of the pressure sensor 110 with the propeller rotational angle information provided by the rotational angle measurer 120 and using the time-synchronized second fluctuating pressure information and propeller rotational angle information.

In this case, the second cavitation information is propeller rotational angle range information when the value of pressure applied to the stern of the ship located in the water near the ascending propeller blade 2 is equal to or greater than a set value or propeller rotational angle information when the value of pressure applied to the stern of the ship located in the water near the ascending propeller blade 2 is a peak value. That is, the second cavitation information is also generated through the following two embodiments.

Hereinafter, a first embodiment of generating the second cavitation information will be described.

B of FIG. 4 is a view showing an example of time-synchronization of the second fluctuating pressure information provided by the second pressure detection sensor 112 with the propeller rotational angle information provided by the rotational angle measurer 120.

In the 1-3rd step S130, a propeller rotational angle range when the value of pressure applied to the stern of the ship located in the water near the ascending propeller blade 2 is equal to or greater than a set value is determined using information obtained by time-synchronizing the second fluctuating pressure information provided by the second pressure detection sensor 112 with the propeller rotational angle information provided by the rotational angle measurer 120 (refer to B of FIG. 4), and information about the determined propeller rotational angle range is generated as the second cavitation information.

Referring to B of FIG. 4, a propeller rotational angle range when the value of pressure applied to the stern of the ship located in the water near the ascending propeller blade 2 is equal to or greater than a set value is determined to be 280 to 300 degrees, and information about the determined propeller rotational angle range, i.e., 280 to 300 degrees, is generated as the second cavitation information.

When cavitation occurs, the flow of water changes due to the cavitation, causing change in the pressure applied to the stern of the ship. In other words, pressure applied to the stern of the ship when cavitation occurs is greater than pressure applied to the stern of the ship when cavitation does not occur. It can be seen from B of FIG. 4 that, when the rotational angle of the propeller is in the range of 280 to 300 degrees, pressure having a set value or more is applied to the stern of the ship located in the water near the ascending propeller blade 2. This means that cavitation occurs on the ascending propeller blade 2 when the rotational angle of the propeller is in the range of 280 to 300 degrees.

Hereinafter, a second embodiment of generating the second cavitation information will be described.

B of FIG. 4 is a view showing an example of time-synchronization of the second fluctuating pressure information provided by the second pressure detection sensor 112 with the propeller rotational angle information provided by the rotational angle measurer 120.

In the 1-3rd step S130, a propeller rotational angle when the value of pressure applied to the stern of the ship located in the water near the ascending propeller blade 2 is a peak value is determined using information obtained by time-synchronizing the second fluctuating pressure information provided by the second pressure detection sensor 112 with the propeller rotational angle information provided by the rotational angle measurer 120 (refer to B of FIG. 4), and information about the determined propeller rotational angle is generated as the second cavitation information.

Referring to B of FIG. 4, a propeller rotational angle when the value of pressure applied to the stern of the ship located in the water near the ascending propeller blade 2 is a peak value is determined to be 288 degrees, and information about the determined propeller rotational angle, i.e., 288 degrees, is generated as the second cavitation information.

When cavitation occurs, the flow of water changes due to the cavitation, causing change in the pressure applied to the stern of the ship. In other words, pressure applied to the stern of the ship when cavitation occurs is greater than pressure applied to the stern of the ship when cavitation does not occur. The highest pressure is applied to the stern of the ship when cavitation having the highest intensity occurs.

It can be seen from B of FIG. 4 that, when the rotational angle of the propeller is 288 degrees, the highest pressure is applied to the stern of the ship located in the water near the ascending propeller blade 2. This means that cavitation having the highest intensity occurs on the surface of the ascending propeller blade 2 when the rotational angle of the propeller is 288 degrees.

In addition, in the 1-3rd step S130 performed by the data processor 130, when the first cavitation information and the second cavitation information are generated, cavitation information including the first cavitation information and the second cavitation information is generated, and the generated cavitation information is provided to the rotational speed controller 200.

The second step S200 is a step of measuring a rotational angle of the propeller 1 in real time after generation of the cavitation information. The second step S200 is performed by the rotational angle measurer 120.

That is, when the cavitation information is generated, the rotational angle measurer 120 provides information about the real-time measured rotational angle of the propeller (refer to C of FIG. 3) to the data processor 130, and when rotation of the propeller is controlled after generation of the cavitation information, the rotational angle measurer 120 provides information about the real-time measured rotational angle of the propeller (refer to C of FIG. 3) to the rotational speed controller 200.

The third step S300 is a step of changing the rotational speed of the propeller 1 using the cavitation information generated in the first step S100 and information about the rotational angle of the propeller 1 measured in real time in the second step S200 such that occurrence of cavitation is reduced. The third step S300 is performed by the rotational speed controller 200.

In other words, in the third step S300, speed control information of the propeller 1 is calculated using the cavitation information generated in the first step S100, and the rotational speed of the propeller 1 is controlled to be changed (increased or decreased) at a specific rotational angle of the propeller using the calculated speed control information and information about the rotational angle of the propeller 1 measured in real time in the second step S200 such that cavitation is reduced.

In detail, as shown in FIG. 2, the third step S300 includes a 3-1$^{st}$ step S310 of calculating speed control information including information about a speed change range within which the rotational speed of the propeller is to be changed and information about a speed variation Δn using the cavitation information generated in the first step S100 and a 3-2$^{nd}$ step S320 of changing the rotational speed of the propeller using information about the rotational angle of the propeller measured in real time in the second step S200 and the speed control information calculated in the 3-1$^{st}$ step S310.

The 3-1$^{st}$ step S310 is a step of calculating speed control information including information about a speed change range within which the rotational speed of the propeller is to be changed and information about a speed variation Δn using the cavitation information generated in the first step S100. The speed control information is calculated through the following two embodiments.

Hereinafter, a first embodiment of calculating the speed control information will be described.

The speed change range included in the speed control information generated in the 3-1$^{st}$ step S310 includes the propeller rotational angle range included in the cavitation information when the value of pressure applied to the stern of the ship located in the water near the descending propeller blade 2 is equal to or greater than a set value and the propeller rotational angle range included in the cavitation information when the value of pressure applied to the stern of the ship located in the water near the ascending propeller blade 2 is equal to or greater than a set value, and the speed variation Δn included in the speed control information generated in the 3-1$^{st}$ step S310 is a value falling within 5% of a reference speed of the propeller.

For example, when the propeller rotational angle range information included in the cavitation information when the value of pressure applied to the stern of the ship located in the water near the descending propeller blade 2 is equal to or greater than a set value is 20 to 40 degrees and when the propeller rotational angle range information included in the cavitation information when the value of pressure applied to the stern of the ship located in the water near the ascending propeller blade 2 is equal to or greater than a set value is 280 to 300 degrees, as shown in A of FIG. 5, 20 to 40 degrees and 280 to 300 degrees are calculated as the speed change ranges to be included in the speed control information. For example, when the reference speed (reference rotational speed) of the propeller 1 is 60 rpm, a certain speed value (e.g., 2 rpm) falling within 5% of the reference speed of the propeller, i.e., 0.1 to 3 rpm, is calculated as the speed variation Δn to be included in the speed control information.

Hereinafter, a second embodiment of calculating the speed control information will be described.

The speed change range included in the speed control information generated in the 3-1$^{st}$ step S310 includes a range of +10 degrees of the rotational angle of the propeller included in the cavitation information when the value of pressure applied to the stern of the ship located in the water near the descending propeller blade 2 is a peak value and a range of +10 degrees of the rotational angle of the propeller included in the cavitation information generated in the first step S100 when the value of pressure applied to the stern of the ship located in the water near the ascending propeller blade 2 is a peak value, and the speed variation Δn included in the speed control information generated in the 3-1$^{st}$ step S310 is a value falling within 5% of a reference speed of the propeller.

In particular, the reason why a range of +10 degrees of the rotational angle of the propeller when the value of pressure applied to the stern of the ship located in the water near the (descending or ascending) propeller blade 2 is a peak value is calculated as the speed change range is that cavitation having the highest intensity occurs on the surface of the propeller blade 2 at the rotational angle of the propeller when the value of pressure applied to the stern of the ship is a peak value and that cavitation having certain intensity, though not the highest intensity, also occurs in a rotational angle range around the rotational angle of the propeller when the value of pressure applied to the stern of the ship is a peak value.

Figure 5:
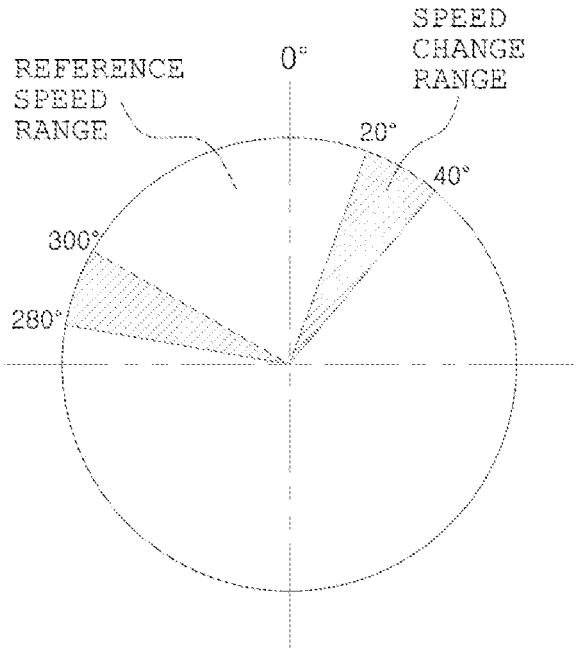
FIG. 5 is a view showing an example of performing a second step of the present invention.
Figure 5:
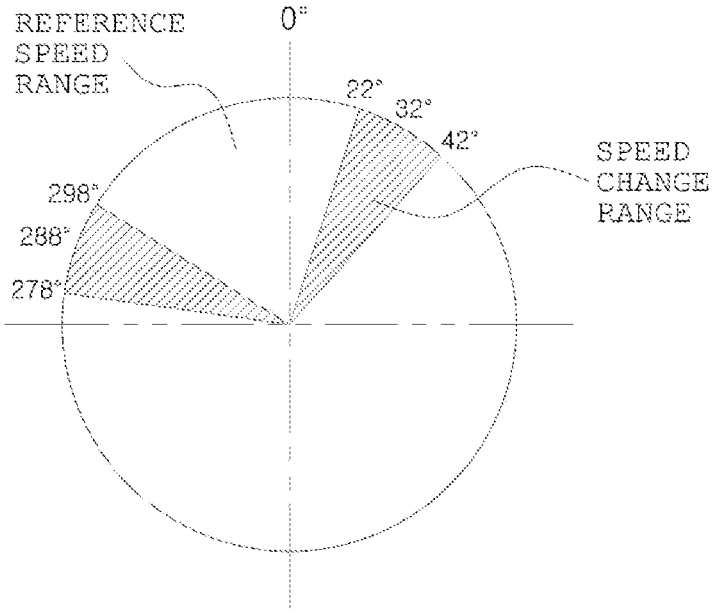

For example, when the propeller rotational angle included in the cavitation information when the value of pressure applied to the stern of the ship located in the water near the descending propeller blade 2 is a peak value is 32 degrees and when the propeller rotational angle included in the cavitation information when the value of pressure applied to the stern of the ship located in the water near the ascending propeller blade 2 is a peak value is 288 degrees, as shown in B of FIG. 5, a range of +10 degrees of 32 degrees and a range of +10 degrees of 288 degrees, i.e., 22 to 42 degrees and 278 to 298 degrees, are calculated as the speed change ranges to be included in the speed control information. For example, when the reference speed (reference rotational speed) of the propeller 1 is 60 rpm, a certain speed value (e.g., 2 rpm) falling within 5% of the reference speed of the propeller, i.e., 0.1 to 3 rpm, is calculated as the speed variation Δn to be included in the speed control information.

The 3-2$^{nd}$ step S320 is a step of changing the rotational speed of the propeller using information about the rotational angle of the propeller measured in real time in the second step S200 and the speed control information calculated in the 3-1$^{st}$ step S310. The rotational speed of the propeller is controlled through the following two embodiments.

The occurrence of cavitation is influenced by the structure of the propeller blades and the flow rate and flow characteristics of water contacting the propeller blades.

In detail, when a propeller including a blade having a specific structure rotates in the water, cavitation may or may not occur on the propeller blade depending on an angle (angle of attack) at which water strikes the propeller blade having a specific structure. That is, the propeller blade having a specific structure has a certain angle (angle of attack) causing occurrence of cavitation when water strikes a specific propeller blade at the corresponding angle.

Therefore, when cavitation occurs, it is possible to prevent or reduce occurrence of cavitation by changing the structure of the propeller blade or changing the angle (angle of attack) at which water strikes the propeller blade, which is the flow characteristic of water contacting the propeller blade.

However, since it is impossible to change the structure of the propeller blade of a ship that is sailing, the angle (angle of attack) at which water strikes the propeller blade, which is the flow characteristic of water contacting the propeller blade, is changed in order to suppress occurrence of cavitation. To this end, the rotational speed of the propeller is changed at the rotational angle of the propeller at which cavitation occurs.

For example, when a propeller blade having a specific structure "A" rotates at a specific speed in the water and there is an angle of attack "a" (angle at which water strikes the propeller blade) that causes cavitation on the propeller blade having the specific structure "A", it is possible to change the angle (angle of attack) at which water strikes the propeller blade having the specific structure "A" from "a" to "b" by changing (increasing or decreasing) the rotational speed of the propeller, thereby preventing or reducing occurrence of cavitation on the propeller blade having the specific structure "A".

First, a first embodiment of speed control will be described.

In detail, in the 3-2$^{nd}$ step S320 according to the first embodiment of speed control, the rotational speed of the propeller is changed using an inverter and a motor in a manner of rotating the propeller at a speed higher or lower than the reference speed by the speed variation Δn in all of the speed change ranges included in the speed control information and rotating the propeller at the reference speed in ranges other than the speed change ranges.

For example, when the speed change range information included in the speed control information corresponds to 20 to 40 degrees and 280 to 300 degrees, as shown in A of FIG. 5, or corresponds to 22 to 42 degrees and 278 to 298 degrees, as shown in B of FIG. 5, and when the speed variation Δn information corresponds to 2 rpm, the 3-2$^{nd}$ step S320 according to the first embodiment of speed control includes determining a current rotational angle of the propeller using information about the rotational angle of the propeller measured in real time in the second step S200.

When the determined current rotational angle of the propeller is outside the speed change ranges (20 to 40 degrees and 280 to 300 degrees shown in A of FIG. 5 or 22 to 42 degrees and 278 to 298 degrees shown in B of FIG. 5), the propeller is rotated at the reference speed (e.g., 60 rpm). When the determined current rotational angle of the propeller is within the speed change ranges (20 to 40 degrees and 280 to 300 degrees shown in A of FIG. 5 or 22 to 42 degrees and 278 to 298 degrees shown in B of FIG. 5), the propeller is rotated at a speed higher or lower than the reference speed (e.g., 60 rpm) by the speed variation Δn, i.e., 2 rpm. That is, the rotational speed of the propeller is increased to 62 rpm in all of the speed change ranges, or is decreased to 58 rpm in all of the speed change ranges.

Next, a second embodiment of speed control will be described.

In the 3-2$^{nd}$ step S320, the rotational speed of the propeller is changed using an inverter and a motor in a manner of rotating the propeller at a speed higher than the reference speed by the speed variation Δn in a speed change range corresponding to a first-half rotation range (0 to 180 degrees) of the propeller among the speed change ranges included in the speed control information and rotating the propeller at a speed lower than the reference speed by the speed variation Δn in a speed change range corresponding to a second-half rotation range (180 to 360 degrees) of the propeller among the speed change ranges included in the speed control information.

Alternatively, in the 3-2$^{nd}$ step S320, the rotational speed of the propeller is changed using the inverter and the motor in a manner of rotating the propeller at a speed lower than the reference speed by the speed variation Δn in a speed change range corresponding to the first-half rotation range (0 to 180 degrees) of the propeller among the speed change ranges included in the speed control information and rotating the propeller at a speed higher than the reference speed by the speed variation Δn in a speed change range corresponding to the second-half rotation range (180 to 360 degrees) of the propeller among the speed change ranges included in the speed control information.

For example, when the speed change range information included in the speed control information corresponds to 20 to 40 degrees and 280 to 300 degrees, as shown in A of FIG. 5, or corresponds to 22 to 42 degrees and 278 to 298 degrees, as shown in B of FIG. 5, and when the speed variation Δn information corresponds to 2 rpm, the 3-2$^{nd}$ step S320 according to the second embodiment of speed control includes determining a current rotational angle of the propeller using information about the rotational angle of the propeller measured in real time in the second step S200.

When the determined current rotational angle of the propeller is outside the speed change ranges (20 to 40 degrees and 280 to 300 degrees shown in A of FIG. 5 or 22 to 42 degrees and 278 to 298 degrees shown in B of FIG. 5), the propeller is rotated at the reference speed (e.g., 60 rpm).

However, when the determined current rotational angle of the propeller is within a speed change range (20 to 40 degrees shown in A of FIG. 5 or 22 to 42 degrees shown in B of FIG. 5) corresponding to the first-half rotation range (0 to 180 degrees) of the propeller among the speed change ranges (20 to 40 degrees and 280 to 300 degrees shown in A of FIG. 5 or 22 to 42 degrees and 278 to 298 degrees shown in B of FIG. 5), the propeller is rotated at 62 rpm, which is higher than the reference speed (e.g., 60 rpm) by the speed variation Δn, i.e., 2 rpm, and when the determined current rotational angle of the propeller is within a speed change range (280 to 300 degrees shown in A of FIG. 5 or 278 to 298 degrees shown in B of FIG. 5) corresponding to the second-half rotation range (180 to 360 degrees) of the propeller among the speed change ranges (20 to 40 degrees and 280 to 300 degrees shown in A of FIG. 5 or 22 to 42 degrees and 278 to 298 degrees shown in B of FIG. 5), the propeller is rotated at 58 rpm, which is lower than the reference speed (e.g., 60 rpm) by the speed variation Δn, i.e., 2 rpm.

To the contrary, when the determined current rotational angle of the propeller is within a speed change range (20 to 40 degrees shown in A of FIG. 5 or 22 to 42 degrees shown in B of FIG. 5) corresponding to the first-half rotation range (0 to 180 degrees) of the propeller among the speed change ranges (20 to 40 degrees and 280 to 300 degrees shown in A of FIG. 5 or 22 to 42 degrees and 278 to 298 degrees shown in B of FIG. 5), the propeller is rotated at 58 rpm, which is lower than the reference speed (e.g., 60 rpm) by the speed variation Δn, i.e., 2 rpm, and when the determined current rotational angle of the propeller is within a speed change range (280 to 300 degrees shown in A of FIG. 5 or 278 to 298 degrees shown in B of FIG. 5) corresponding to the second-half rotation range (180 to 360 degrees) of the propeller among the speed change ranges (20 to 40 degrees and 280 to 300 degrees shown in A of FIG. 5 or 22 to 42 degrees and 278 to 298 degrees shown in B of FIG. 5), the propeller is rotated at 62 rpm, which is higher than the reference speed (e.g., 60 rpm) by the speed variation Δn, i.e., 2 rpm.

As is apparent from the above description, the method of controlling the rotational speed of a propeller of a ship to reduce cavitation according to the present invention may reduce cavitation by determining a rotational angle range of a propeller corresponding to a cavitation occurrence section when cavitation occurs during sailing of a ship and by increasing or reducing the rotational speed of the propeller within the determined rotational angle range of the propeller corresponding to the cavitation occurrence section, thereby exhibiting effects of simply reducing cavitation only by controlling the rotational speed of the propeller without changing the structure of the propeller.

Although the preferred embodiments of the present invention have been disclosed for illustrative purposes, those skilled in the art will appreciate that various modifications, additions and substitutions are possible, without departing from the scope and spirit of the invention as disclosed in the appended claims.

What is claimed is:

1. A method for controlling a rotational speed of a propeller of a ship to reduce cavitation, the method comprising:

generating cavitation information about the cavitation occurring during rotation of the propeller;

measuring a rotational angle of the propeller in real time after generating the cavitation information; and changing a rotational speed of the propeller using the generated cavitation information and the measured rotational angle of the propeller such that an occurrence of the cavitation is reduced, wherein the cavitation information comprises information about a rotational angle of the propeller at a time of the occurrence of the cavitation, wherein the generating of the cavitation information comprises:

measuring fluctuating pressure applied to a stern of the ship in water, the fluctuating pressure being caused by the cavitation occurring on surfaces of blades of the propeller during the rotation of the propeller;

measuring the rotational angle of the propeller to generate the cavitation information; and generating the cavitation information by using the measured fluctuating pressure applied to the stern of the ship and the measured rotational angle of the propeller, wherein the generating of the cavitation information further comprises:

time-synchronizing information about a first fluctuating pressure applied to the stern of the ship in water near a descending propeller blade with information about the rotational angle of the propeller, the first fluctuating pressure being caused by the cavitation occurring on a surface of the descending propeller blade during the rotation of the propeller;

generating first cavitation information about the cavitation occurring around the descending propeller blade using the time-synchronized information about the first fluctuating pressure and the measured rotational angle of the propeller;

time-synchronizing information about a second fluctuating pressure applied to the stern of the ship in water near an ascending propeller blade with information about the rotational angle of the propeller, the second fluctuating pressure being caused by the cavitation occurring on a surface of the ascending propeller blade during rotation of the propeller;

generating second cavitation information about the cavitation occurring around the ascending propeller blade using the time-synchronized information about the second fluctuating pressure and the measured rotational angle of the propeller; and generating the cavitation information including the first cavitation information and the second cavitation information.

2. The method according to claim 1, wherein the measuring of the fluctuating pressure comprises:

measuring the first fluctuating pressure applied to the stern of the ship in water near the descending propeller blade, the first fluctuating pressure being caused by the cavitation occurring on the surface of the descending propeller blade during the rotation of the propeller; and measuring the second fluctuating pressure applied to the stern of the ship in water near the ascending propeller blade, the second fluctuating pressure being caused by the cavitation occurring on the surface of the ascending propeller blade during the rotation of the propeller.

3. The method according to claim 1, wherein the first cavitation information is propeller rotational angle range information when a value of the first fluctuating pressure applied to the stern of the ship in water near the descending propeller blade is equal to or greater than a set value, or propeller rotational angle information when the value of the first fluctuating pressure applied to the stern of the ship in water near the descending propeller blade is a peak value, and wherein the second cavitation information is propeller rotational angle range information when a value of the second fluctuating pressure applied to the stern of the ship in water near the ascending propeller blade is equal to or greater than a set value, or propeller rotational angle information when the value of the second fluctuating pressure applied to the stern of the ship in water near the ascending propeller blade is a peak value.

4. The method according to claim 1, wherein the changing of the rotational speed of the propeller comprises:

calculating speed control information comprising information about a speed change range within which the rotational speed of the propeller is to be changed and information about a speed variation using the generated cavitation information; and changing the rotational speed of the propeller using information about the measured rotational angle of the propeller and the calculated speed control information.

5. The method according to claim 4, wherein the speed change range included in the calculated speed control information comprises a propeller rotational angle range included in the first cavitation information when a value of the first fluctuating pressure applied to the stern of a ship in water near the descending propeller blade is equal to or greater than a set value and a propeller rotational angle range included in the second cavitation information when a value of the second fluctuating pressure applied to the stern of the ship in water near the ascending propeller blade is equal to or greater than a set value, and wherein the speed variation included in the calculated speed control information is a value within 5% of a reference speed of the propeller.

6. The method according to claim 4, wherein the speed change range included in the calculated speed control information comprises a range of ±10 degrees of the rotational angle of the propeller included in the first cavitation information when the value of the first fluctuating pressure applied to the stern of a ship located in water near the descending propeller blade is a peak value and a range of ±10 degrees of the rotational angle of the propeller included in the second cavitation information when the value of the second fluctuating pressure applied to the stern of the ship in water near the ascending propeller blade is a peak value, and wherein the speed variation included in the calculated speed control information is a value within 5% of a reference speed of the propeller.

7. The method according to claim 4, wherein the rotational speed of the propeller is changed using an inverter and a motor by rotating the propeller at a speed higher or lower than a reference speed by an amount equal to the speed variation in speed change ranges included in the speed control information, and rotating the propeller at the reference speed in ranges other than the speed change ranges.

8. The method according to claim 4, wherein the rotational speed of the propeller is changed using an inverter and a motor by rotating the propeller at a speed higher than a reference speed by an amount equal to the speed variation in a speed change range corresponding to a first-half rotation range of the propeller among speed change ranges included in the speed control information and rotating the propeller at a speed lower than the reference speed by an amount equal to the speed variation in a speed change range corresponding to a second-half rotation range of the propeller among the speed change ranges included in the speed control information, or the rotational speed of the propeller is changed using the inverter and the motor by rotating the propeller at a speed lower than the reference speed by an amount equal to the speed variation in a speed change range corresponding to the first-half rotation range of the propeller among the speed change ranges included in the speed control information and rotating the propeller at a speed higher than the reference speed by an amount equal to the speed variation in a speed change range corresponding to the second-half rotation range of the propeller among the speed change ranges included in the speed control information, and wherein the first-half rotation range of the propeller is 0 to 180 degrees, and the second-half rotation range of the propeller is 180 to 360 degrees.

* * * * *